US007221361B2

(12) United States Patent
Konishi

(10) Patent No.: US 7,221,361 B2
(45) Date of Patent: May 22, 2007

(54) DISPLAY APPARATUS

(75) Inventor: Isao Konishi, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 319 days.

(21) Appl. No.: 10/337,877

(22) Filed: Jan. 8, 2003

(65) Prior Publication Data

US 2003/0234776 A1 Dec. 25, 2003

(30) Foreign Application Priority Data

Jun. 24, 2002 (JP) ..... 2002-183131

(51) Int. Cl.
*G09G 5/00* (2006.01)
*G09G 5/08* (2006.01)

(52) U.S. Cl. ..... 345/204; 345/156

(58) Field of Classification Search ..... 345/156, 345/158, 211, 214, 204; 375/219, 224
See application file for complete search history.

(56) References Cited

U.S. PATENT DOCUMENTS 5,760,848 A 6/1998 Cho
6,631,159 B1 * 10/2003 Morris ..... 375/219
6,806,975 B1 * 10/2004 Fujita et al. ..... 358/1.14

FOREIGN PATENT DOCUMENTS

EP 0 705 032 A1 4/1996
JP 3-81823 4/1991
JP 5-292429 11/1993
JP 8-116494 5/1996
JP 09-305508 11/1997
JP 10-164114 6/1998
JP 2000-341175 12/2000
JP 2002-312155 10/2002

OTHER PUBLICATIONS

Japanese Patent Office Action issued Jul. 13, 2005.
http://www.watch.impress.co.jp/broadband/news/2002/02/19/msmirea.htm, Feb. 19, 2002.

* cited by examiner

*Primary Examiner*—Dennis-Doon Chow
(74) *Attorney, Agent, or Firm*—Staas & Halsey LLP

(57) ABSTRACT

The present invention relates to a display apparatus that is switched to an image signal via a wireless communication unit automatically when an image signal cable is disconnected from a connector. The image signal is transmitted by a cable 6 connected to the connector C1 of the apparatus D1 or a wireless LAN. When a switch S1 detects that the cable 6 is connected to the connector C1, a switching circuit 2 is switched to the cable-side to display the image signal via the cable. When the switch S1 detects disconnection of the cable 6, the switch circuit is switched to the side of a CPU 5 to display the image signal via the wireless LAN.

8 Claims, 5 Drawing Sheets

DISPLAY APPARATUS

BACKGROUND OF THE INVENTION

1. Field of the Invention

The present invention relates to a display apparatus for displaying an image signal, and more particularly, the present invention relates to a display apparatus for an image signal that can switch transmission paths in response to detection of connection conditions of an image signal cable, and can further switch the transmission paths of a image signal to a wireless communication system automatically when the image signal cable is disconnected from the display apparatus.

2. Description of the Related Art

Conventionally, in a desktop personal computer, for example, peripheral devices such as a keyboard, a display apparatus and a printer are connected to a personal computer main unit. On the other hand, in a notebook personal computer, the keyboard and the display apparatus among these peripheral devices are incorporated in the personal computer main unit. Thus, the display apparatus is indispensable for making full use of features of the personal computer.

But, recently, as lightweight and compact LCDs are more often used, in a display processing unit of the display apparatus, than CRTs that would increase weight of the apparatus, only the display apparatus can be readily moved separately. Further, it has become possible to display more types of contents such as images of CDs, DVDs and television broadcasts, for example, on the display apparatus.

On the other hand, at present, resources are shared by connecting a plurality of personal computers to a network system such as a LAN, wherein image information as the contents are supplied to each personal computer via the LAN. When such image information is displayed on the display apparatus, the image information that is to be displayed on the display processing unit is transmitted from the respective personal computer to the display apparatus via an image signal cable, or a wireless communication system such as a wireless LAN provided between the personal computers and the display apparatus.

However, in the display apparatuses that have been used conventionally, the image signal is supplied from the personal computer via only one fixed connection unit that is either the image signal cable or the wireless LAN.

Thus, in the prior art, it is not possible to switch the connection unit in the display apparatus automatically using any circuit configuration in response to the connection conditions, or in other words, in response to whether the image signal cable is connected to the display apparatus or not.

Further, also in information processing equipment such as a personal computer and a server, it is not possible to switch the connection unit automatically using its internal circuit in response to the connection conditions of the image signal cable.

Therefore, it is an object of the present invention to provide a display apparatus for displaying an image signal supplied from a personal computer and the like that can switch a connection unit automatically using an internal circuit so that one image signal via an image signal cable is displayed when such image signal cable is connected, while another image signal transmitted through other image signal transmission system such as, for example, a wireless transmission system for the personal computer is displayed when the image signal cable is not connected.

SUMMARY OF THE INVENTION

In order to solve the problem described above, according to the present invention, there is provided a display apparatus for displaying a transmitted image signal, comprising: a switching circuit unit for transmitting said image signal to a display processing unit by switching transmission paths between a first transmission path that transmits said image signal that is sent to a connector unit of a cable and a second transmission path that transmits said image signal that is sent via wireless communication; and a detecting circuit unit including a switch that responds to insertion or withdrawal of a connection terminal of said cable into/from said connector unit, wherein said detecting circuit unit switches said switching circuit unit from said first transmission path to said second transmission path when said switch detects the withdrawal of said connection terminal.

Then, when said detecting circuit unit detects that said cable is disconnected from said connector unit, it outputs a reset signal that disables said second transmission path.

Said display processing unit includes a plurality of display processing units, wherein said image signal is supplied to each of said plurality of display processing units by switching the transmission paths between said first transmission path and said second transmission path, or, when said image signal is supplied to one of said plurality of display processing units via. said first transmission path, said image signal is supplied to the other display processing unit by switching to said second transmission path.

Further, according to the present invention, there is provided a display apparatus for transmitting and displaying an image signal generated in information processing equipment, comprising: a switching circuit unit for transmitting said image signal to a display processing unit by switching transmission paths between a first transmission path that transmits said image signal that is sent to a connector unit of a cable and a second transmission path that transmits said image signal that is sent via wireless communication; and a detecting circuit unit including a switch that responds to insertion or withdrawal of a connection terminal of said cable into/from said connector unit, wherein said detecting circuit unit switches said switching circuit unit from said first transmission path to said second transmission path when said switch detects the withdrawal of said connection terminal.

Then, said information processing equipment comprises a detecting circuit unit for detecting connection or disconnection of said first transmission path to/from said display processing unit.

Further, security information with regard to the display in one of said display processing units is set in the respective display processing unit, wherein said detecting circuit unit limits and controls transmission of said image signal to said first transmission path based upon said security information that is read when it detects that said cable is connected to said connector unit of said information processing equipment.

According to the display apparatus configured as described above, the connection conditions of the image signal cable can be detected, and the transmission path through which the image signal is supplied can be switched to the wireless communication automatically when the image signal cable is disconnected from the display apparatus.

BRIEF DESCRIPTION OF THE DRAWINGS

These and other objects and features of the present invention will become clear from the following description of the preferred embodiments given with reference to the attached drawings, wherein.

DETAILED DESCRIPTION OF THE INVENTION

Hereinafter, specific examples of embodiments of a display apparatus according to the present invention will be described with reference to the drawings.

[A First Embodiment]

A display apparatus for a image signal according to a first embodiment can switch the system of transmitting the image signal that can be displayed on a display processing unit of the display apparatus between when the display apparatus is connected to a personal computer via an image signal cable and when the display apparatus is connected to the personal computer via wireless communication system provided with both the display apparatus and the personal computer automatically inside the display apparatus. Here, the personal computer is merely an example of information processing apparatus that can output an image signal.

To that end, the display apparatus according to this embodiment is provided with a switch for detecting whether the image signal cable is connected or not, wherein a switching circuit is activated so that the image signal from the image signal cable is transmitted to the display processing unit when such a switch detects the connection of the image signal cable, or so that the image signal sent by the wireless communication is transmitted to the display processing unit when a such switch detects the disconnection of the image signal cable.

Figure 1:
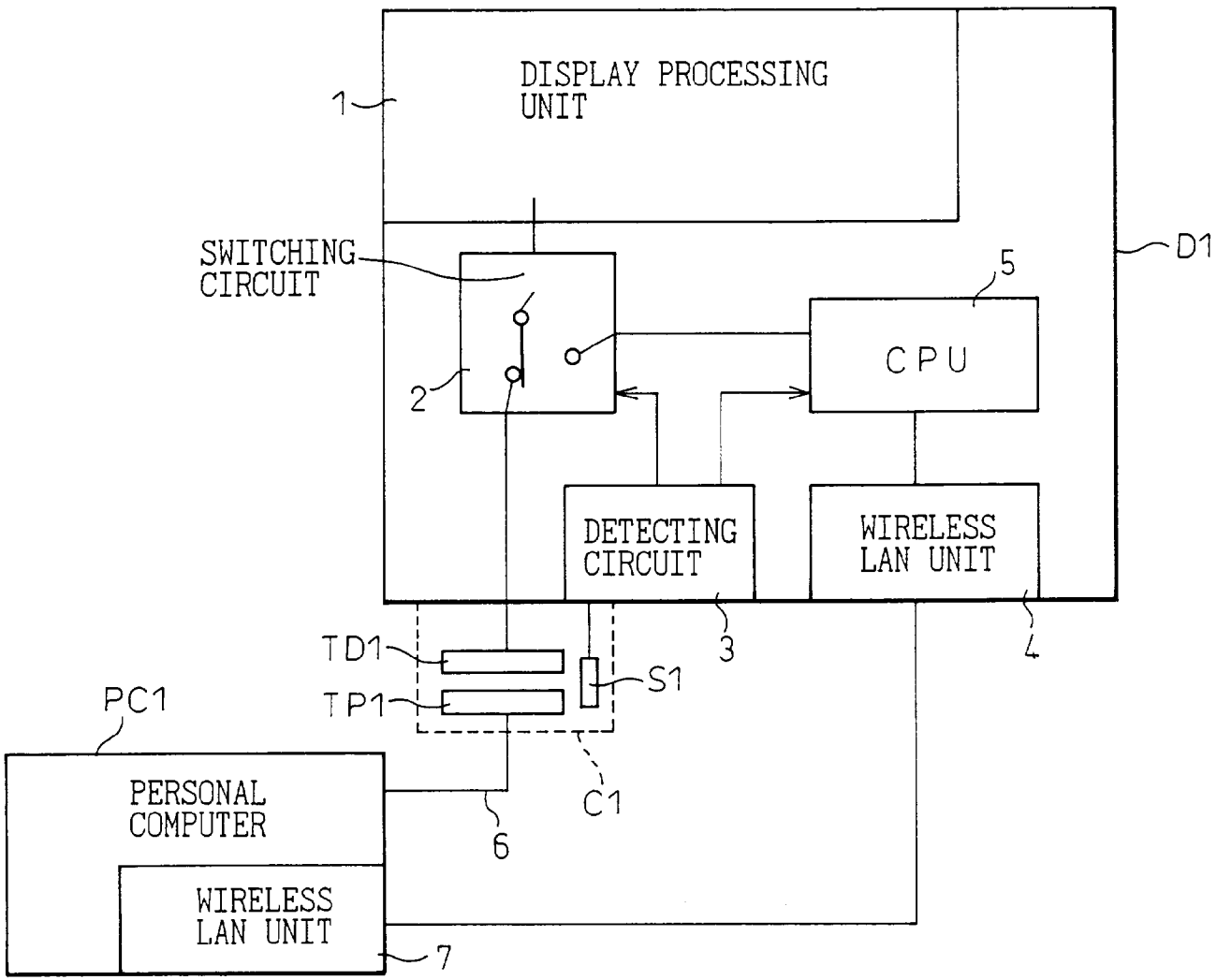
FIG. 1 shows a specific example of connection between a display apparatus and a personal computer to which a connection system according to the present invention is applied.

FIG. 1 shows a specific example of a display apparatus connection system according to the first embodiment of the present invention. A display apparatus D1 comprises a display unit 1, such as a LCD, therein and has a processing unit (not shown) for displaying an image signal on the display unit 1. Further, such an apparatus comprises a switching circuit 2, a detecting circuit 3, a wireless LAN unit 4, and a CPU 5.

The display apparatus D1 comprises a connector C1 for an image signal cable. The connector C1 is comprised of a display-side terminal TD1, a personal computer-side terminal TP1, and a switch S1. The display-side terminal TD1 is connected to the switching circuit 2 while the switch S1 is connected to the detecting circuit 3. When the image signal cable 6 is not connected to the display apparatus D1, the display-side terminal TP1 is withdrawn from the connector C1.

The connector C1 comprises the switch S1. The switch S1 is configured to detect that the image signal cable 6 is connected to the display apparatus D1 when the personal computer-side terminal TP1 is inserted into the connector C1, and, for example, it may be a switch terminal that is turned on when the personal computerside terminal TP1 is inserted, or a switch for detecting the insertion electrically.

On the other hand, the display apparatus D1 comprises a wireless communication system through which the image signal is transmitted from a personal computer PC1. The wireless communication system may include a wireless LAN or Bluetooth or the like. In FIG. 1, an example using a wireless LAN is illustrated wherein wireless LAN units 4 and 7 are mounted on both the display apparatus D1 and the personal computer PC1, respectively, and the image signal generated in the personal computer PC1 is transmitted to the CPU 5 via the wireless LAN. Then, the CPU 5, in turn, supplies the image signal to the display processing unit 1.

Here, the switch S1 sends an ON or OFF signal to the detecting circuit in response to the insertion or withdrawal of the connector C1 to or from the connector C1, respectively. The detecting circuit 3 determines whether the image signal cable 6 is connected to the display apparatus D1 based upon this ON or OFF signal, that is, more specifically, when it receives the ON signal, it determines that the image signal cable 6 is connected and switches the switching circuit 2 to the display-side terminal TD1 to transmit the image signal to the display unit 1.

At this time, as the display unit 1 of the display apparatus D1 can display the image signal only from one side, the signal from the CPU 5 is not supplied. The switching circuit 2 does not transmit the image signal output at the side of the CPU 5 to the display unit 1. Moreover, if necessary, in order to disable operation of the CPU 5, the detecting circuit 3 may be configured to send a reset signal to the CPU 5 when the switching circuit 2 is switched to the side of the connector C1.

Next, when the switch S1 outputs the OFF signal, the detecting circuit 3 detects that the personal computer-side terminal TP1 is withdrawn from the connector C1, or the image signal cable 6 is not connected to the display apparatus D1. At this time, the detecting circuit 3 switches the switching circuit 2 to the side of the CPU 5 to supply the image signal transmitted through the wireless LAN unit 4 to the display processing unit 1.

Though it is assumed in the above description that the detecting circuit 3 switches the switching circuit 2 to the side of the connector C1 by the switch S1 when the image signal cable 6 is connected to the connector C1, the object of the present invention may also be achieved by configuring the switching circuit 2 to always be connected to the side of the connector C1, wherein the detecting circuit 3 detects that the image signal cable 6 is not connected to the connector C1 by the switch S1, and the switching circuit 2 is switched to the side of the CPU 5.

As described above, in the display apparatus connection system according to this embodiment, the connection conditions of the image signal cable that transmits the image signal to the display apparatus can be detected by the switch in the connector included in the display apparatus to control the switching circuit so that the transmission path of the image signal to the display processing unit can be automatically switched between the image signal cable and the wireless LAN in the display apparatus.

Figure 2:
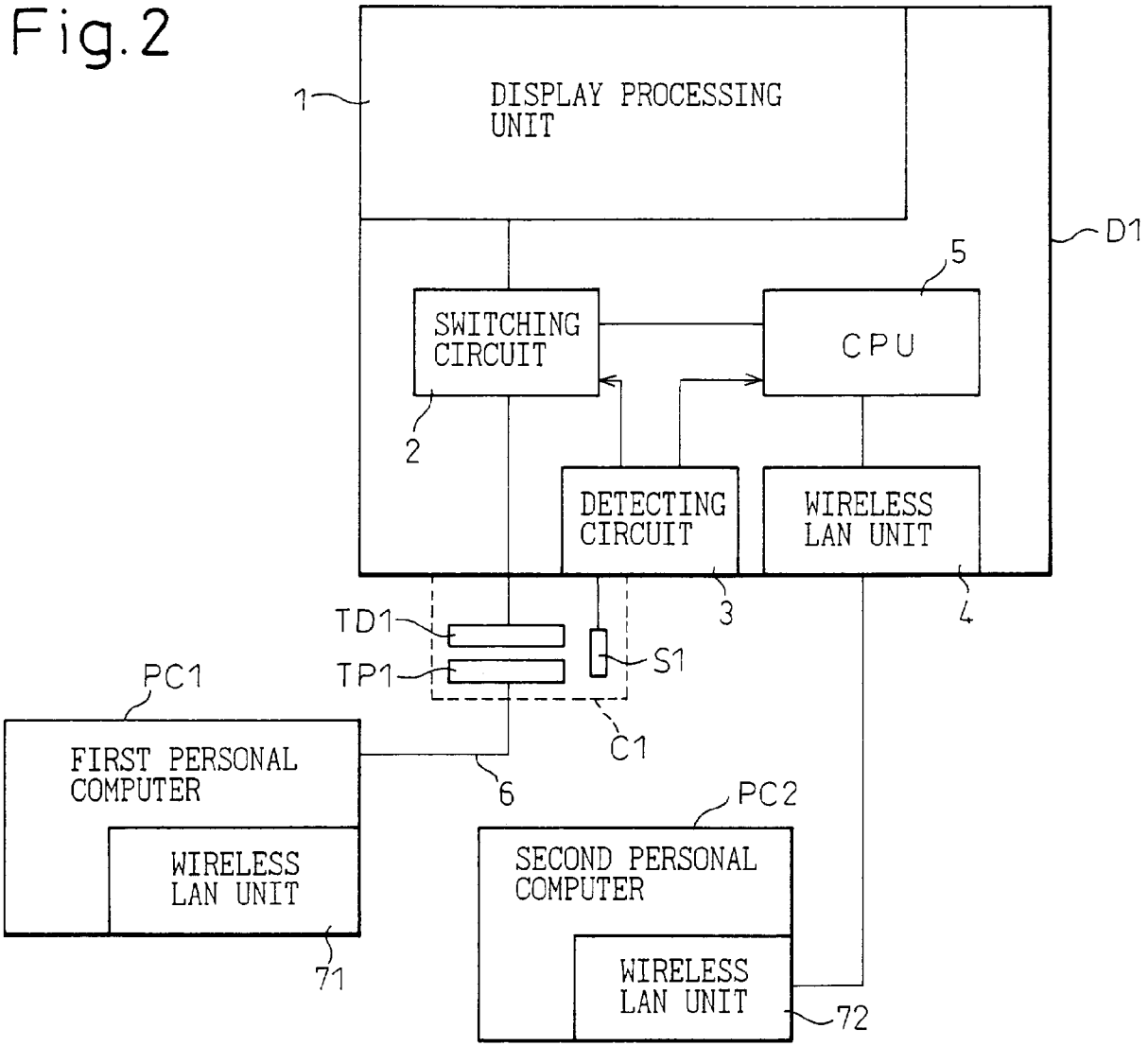
FIG. 2 shows a specific example of connection between a display apparatus and two personal computers to which a connection system according to the present invention is applied.

Next, with reference to FIG. 2, there is shown a specific example using another connection configuration of a display apparatus to which the display apparatus connection system according to the first embodiment is applied. Since the display apparatus D1 that is similar to the one shown in FIG. 1 is used also in FIG. 2, like elements are designated by like reference numerals.

In the case of the display apparatus D1 shown in FIG. 1, one personal computer PC1 is connected to one display apparatus D1 wherein connection conditions of the respective transmission path can be detected and changed in the display apparatus D1 when the image signal from the personal computer PC1 is transmitted on either one of the image signal cable 6 and the wireless communication selectively. In contrast, in the exemplary connection conditions of the display apparatus D1 shown in FIG. 2, an image signal is transmitted from any one of two or more personal computers to one identical display apparatus and displayed on the display apparatus.

With reference to FIG. 2, a case in which an image signal generated in a first personal computer PC1 is transmitted by an image signal cable 6 and then displayed will be described first.

In this case, a detecting circuit 3 detects connection of the image signal cable 6 by a switch S1, switches a switching circuit 2 to the side of a connector C1, and simultaneously sends a reset signal to a CPU 5. It allows a display processing unit 1 to display the image signal transmitted from the first personal computer PC1 via the image signal cable 6 and disables the image signal transmitted from a second personal computer PC2 via wireless communication.

On the other hand, when it is desired to display the image signal generated in the second personal computer PC2 on the display processing unit 1, a personal computer-side terminal TP1 of the image signal cable 6 is withdrawn from the connector C1 to disconnect the image signal cable 6 from the display apparatus D1. At this time, the detecting circuit 3 switches the switching circuit 2 to the side of the CPU 5. It allows the image signal transmitted from the second personal computer PC2 via the wireless communication to be transmitted to the CPU 5 via a wireless communication unit 4 and then supplied to the display processing unit 1 via the switching circuit 2 to be displayed thereon.

Here, though one personal computer is shown as an example of the second personal computer PC2 in FIG. 2, it is to be noted that, depending on the configuration of the wireless communication, a plurality of personal computers may be incorporated by equipping each personal computer with a respective wireless communication unit, wherein the image signal transmitted from each personal computer can be displayed selectively.

Also in the case in which the image signal is transmitted from the plurality of personal computers as described above, in the display apparatus according to this embodiment, the connection conditions of the image signal cable that transmits the image signal to the display apparatus can be detected by the switch in the connection connector included in the display apparatus to control the switch circuit so that the transmission path of the image signal to the display processing unit can be switched to either one of the image signal cable and the wireless communication automatically.

Next, still another connection configuration of the display apparatus according to the present invention in which two or more display apparatus that are identical to the one shown in FIG. 1 are provided and an identical image signal generated in one personal computer is transmitted to each display apparatus will be described with reference to FIG. 3.

Both a first display apparatus D1 and a second display apparatus D2 are configured similarly to the display apparatus D1, shown in FIG. 1, and like elements are designated by like reference numerals. A personal computer PC1 can generate an image signal internally and perform both wired transmission by an image signal cable 6 and wireless transmission by a wireless LAN unit 7 of such image signal. Thus, the image signal is transmitted from the personal computer PC1 to the first display apparatus D1 via the image signal cable in a wired manner, and the same image signal is also transmitted from the personal computer PC1 to the other display apparatus via the wireless LAN in a wireless manner.

First, paying attention to the first display apparatus D1, as the image signal cable 6 is connected to a connector C1, the detecting circuit 3 detects connection conditions by a switch S1 and switches a switching circuit 2 to the side of the connector C1. It allows a display processing unit to display the image signal transmitted via the image signal cable 6. Here, though the image signal from CPU 5 is not output to the display processing unit 1 when the switching circuit 2 is switched to the side of the connector C1, the image signal received by a wireless LAN unit 4 is disabled since a reset signal is sent from the detecting circuit 3 to the CPU 5.

On the other hand, in the second display apparatus D2, since the image signal cable 6 is not connected to a connector C2, a detecting circuit 13 detects disconnection of the image signal cable and switches a switching circuit 12 to the side of a CPU 15. At this time, as the detecting circuit 13 does not send the reset signal to the CPU 15 and allows the CPU 15 to operate effectively, the image signal sent from the personal computer PC1 wirelessly is received at a wireless LAN unit 14 and then supplied to a display unit 1, via a switching circuit 12, to be displayed.

As described above, the image signal can be displayed on the plurality of display apparatus by sending the image signal simultaneously from one personal computer to the plurality of display apparatus that can detect the connection conditions of the image signal cable and switch the transmission paths of the image signal automatically.

[A Second Embodiment]

In the display apparatus according to the first embodiment, the connection conditions of the image signal cable is detected at the side of the display apparatus and the transmission paths are switched between the image signal cable and the wireless communication in the display apparatus to display the image signal. In this case, the transmission paths cannot be switched between the image signal cable and the wireless communication automatically unless the features for detecting the connection conditions of the image signal cable are implemented in every display apparatus.

In view of the above problem, in the display apparatus connection system according to a second embodiment, the features for detecting the connection conditions of the image signal cable are implemented not in the display apparatus but in a personal computer that generates the image signal. As the transmission paths are automatically switched between the image signal cable and the wireless communication at the side of the personal computer, the image signal can also be transmitted to a typical display apparatus that does not have such features.

Figure 4:
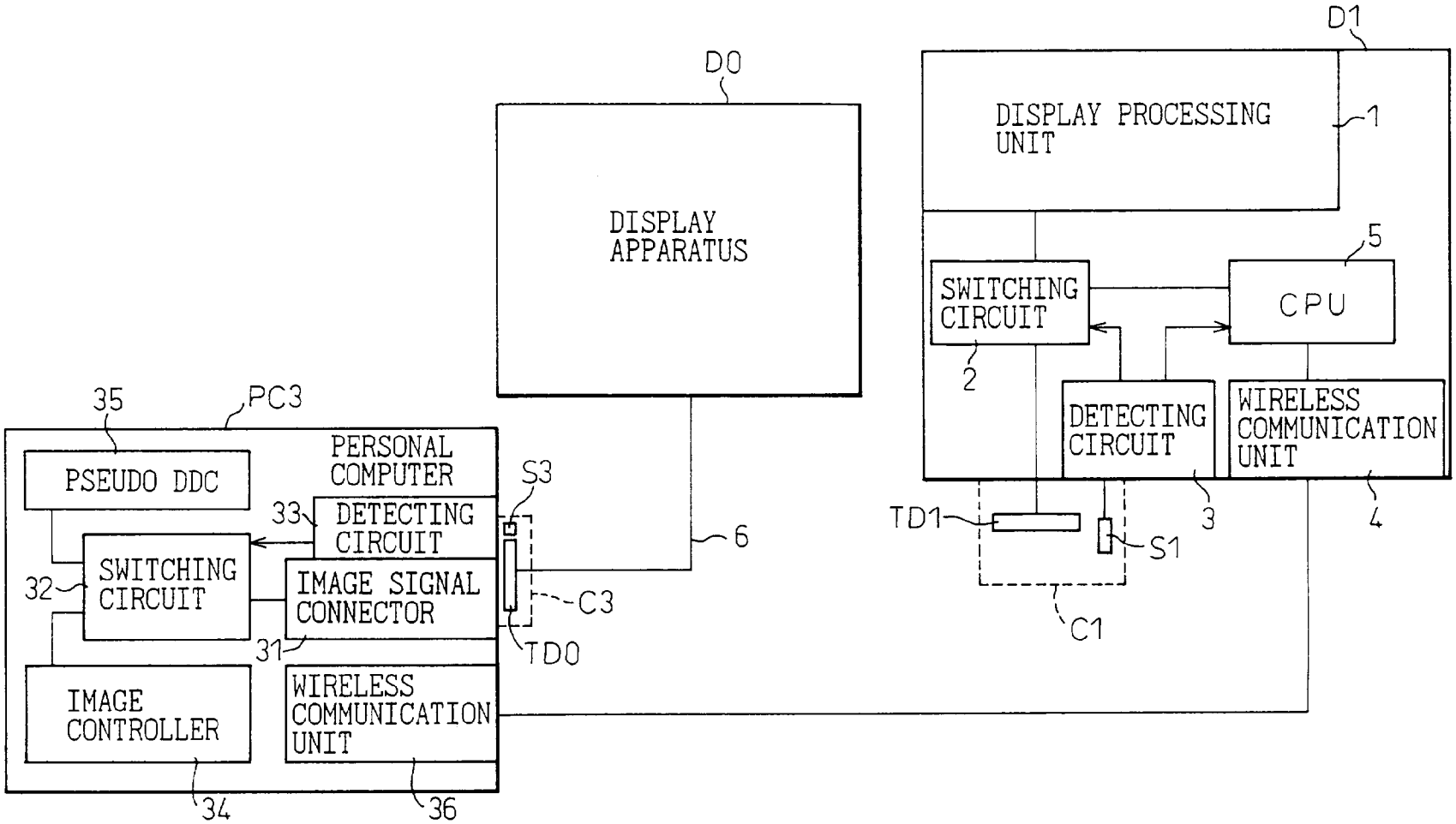
FIG. 4 shows a specific example of connection between a personal computer and the other display apparatus to which a connection system according to the present invention is applied.

A specific example of a connection configuration between a personal computer and display apparatus is shown in FIG. 4. In this figure, one of the display apparatus is designated as D0, which is a typical display apparatus to which an image signal is supplied only from an image signal cable. Another display apparatus D1 is configured similarly to the display apparatus D1 shown in FIG. 1, wherein like elements are designated by like reference numerals. Though the display apparatus having features for detecting connection conditions of the image signal cable at the apparatus side are used, it may be sufficient for this specific connection configuration if the display apparatus is supplied with the image signal at least via wireless communication and can display the image signal.

In order to detect the connection conditions of an image signal cable 6 that transmits the image signal to the display apparatus D0 at the side of a personal computer PC3, a detecting circuit 33 to which a switch S3 is connected is disposed in an image signal connector 31 for outputting the image signal of the personal computer PC3. When a display-side terminal TD0 of the image signal cable 6 is inserted into the image signal connector 31, the detecting circuit 33 detects connection of the image signal cable 6 by the switch S3 and activates a switching circuit 32.

At this time, the switching circuit 32 is switched to the side of an image controller unit 34 so that a DDC signal is output from the image controller unit 34 to an image signal connector 31 and a plug and play process is performed with the display apparatus D0. Then, the image signal is transmitted to the display apparatus D0 via the image signal cable 6 and displayed thereon.

On the other hand, when the display-side terminal TD0 of the image signal cable 6 is withdrawn from the image signal cable 31, or the image signal cable 6 has not been connected to the personal computer PC3 from the beginning, the detecting circuit 33 detects disconnection of the image signal cable 6 by the switch S3 and switches the switching circuit 32 to the side of a pseudo DDC signal generation unit 35. This pseudo DDC generation unit 35 enables wireless communication with the display apparatus D1 via a wireless LAN unit 36, and allows an image signal controller 34 to generate the DDC signal that is necessary for performing a plug and play process.

Here, when the image signal generated in the personal computer PC3 is transmitted from the wireless communication unit 36, in the display apparatus D1, the image signal is received by a wireless communication unit 4 and displayed by a display processing unit 1. Here, though the display apparatus D1 is provided with features for detecting connection conditions of the image signal cable, it is to be understood that the image signal cable is not connected to the display apparatus D1 at this time, and therefore, the switching circuit 2 is switched to the side of the CPU 5 and the transmission path of the image signal via the wireless communication is enabled.

As described above, in the image signal display apparatus according to this embodiment, as the personal computer is provided with the features for detecting the connection conditions of the image signal cable between the personal computer and the display apparatus, the personal computer can automatically switch the transmission paths to transmit the image signal to the display apparatus even when either the image signal cable or the wireless communication is selected fixedly to transmit the image signal at the side of the display apparatus.

Figure 5:
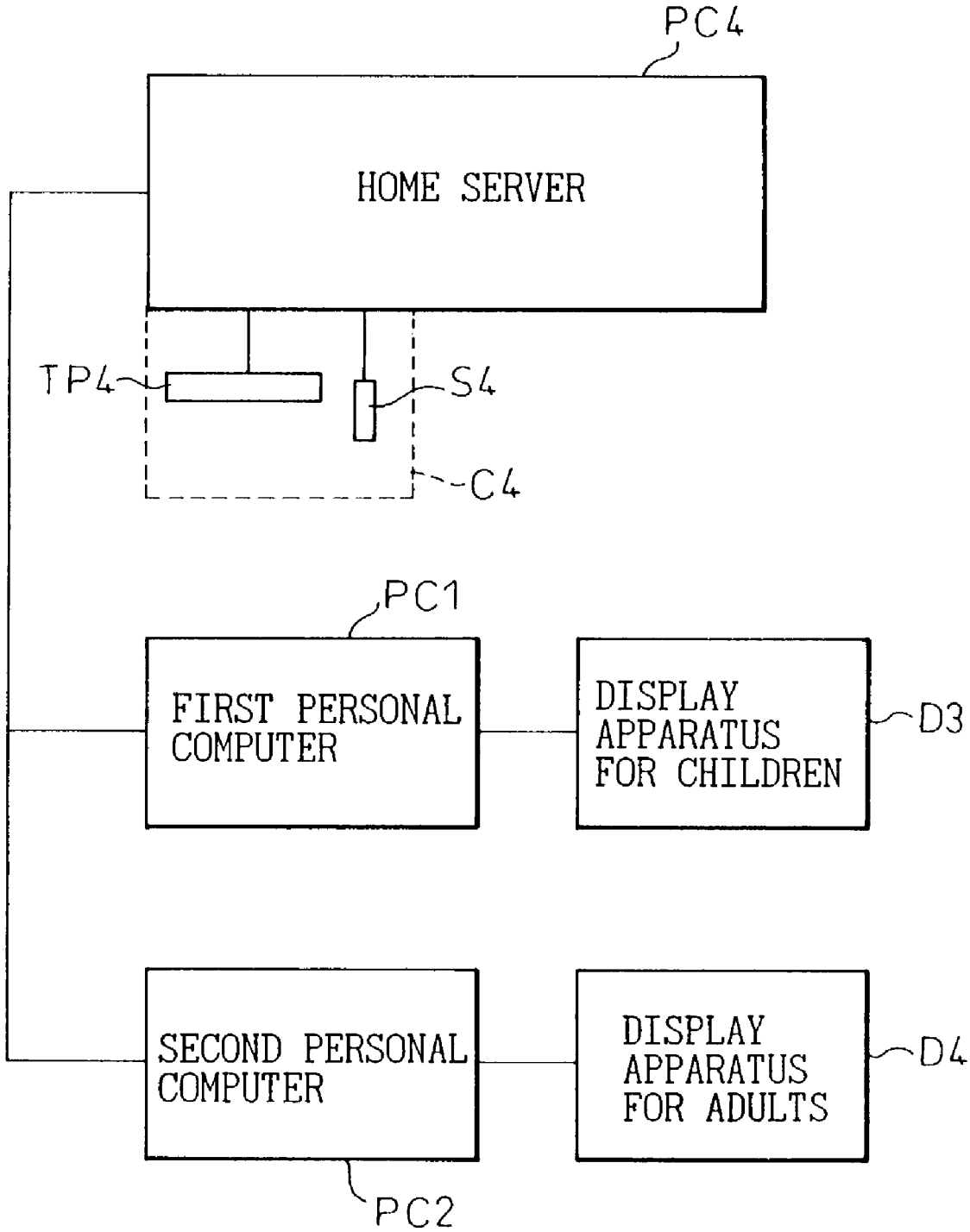
FIG. 5 shows a specific example of connection when a personal computer is notified of security information of a display apparatus by employing a connection system according to the present invention.

Next, in FIG. 5, there is shown an exemplary connection configuration of the display apparatus connection system in which, for example, the personal computer PC3 as shown in FIG. 4 is used as a home server to display, for example, image information from a web site on a plurality of personal computers that are connected via a LAN. Here, display apparatus D3 and D4 provided in a plurality of personal computers PC1 and PC2 can operate remotely from each personal computer.

Figure 3:
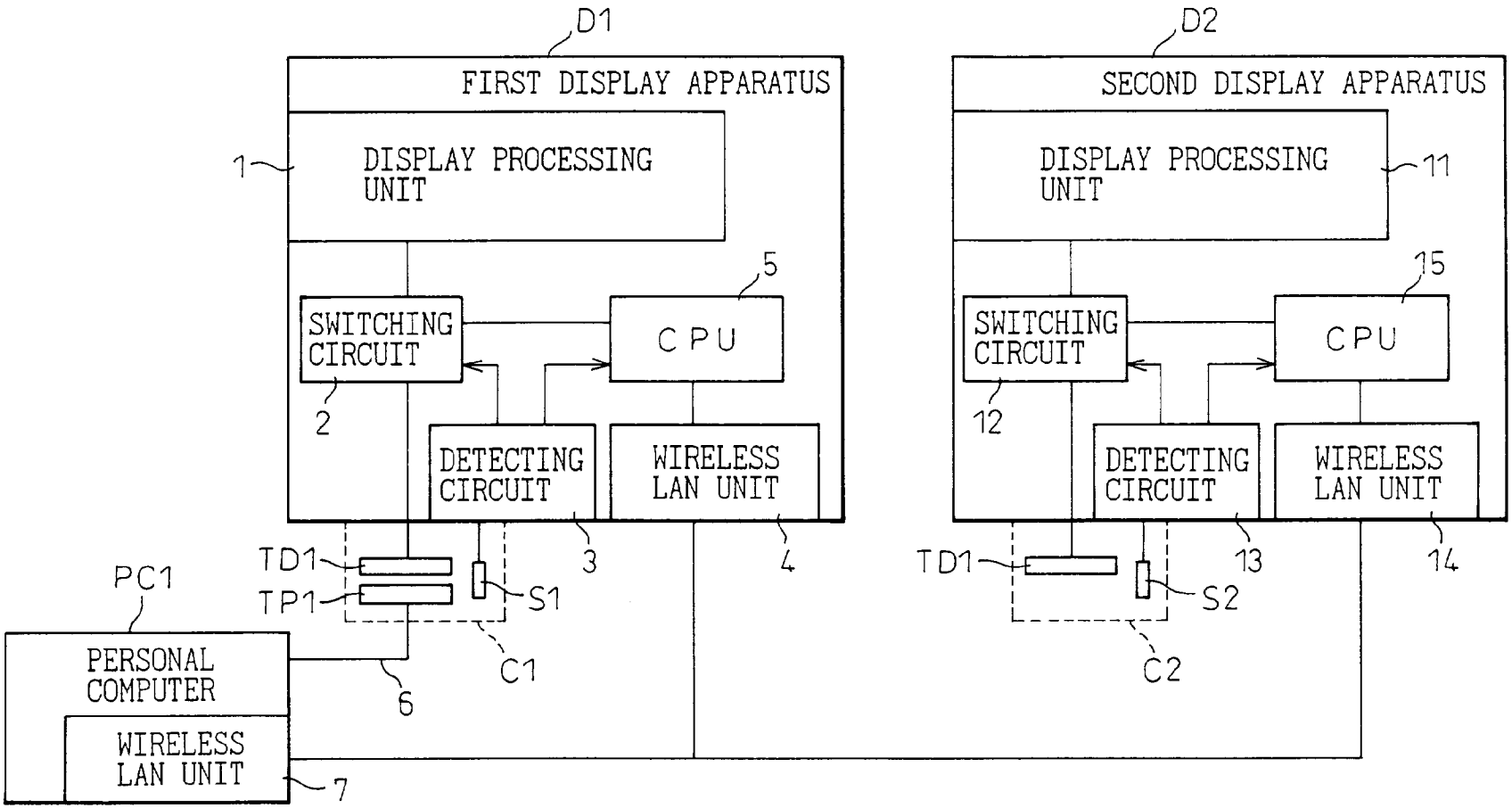
FIG. 3 shows a specific example of connection between two display apparatus and a personal computer to which a connection system according to the present invention is applied.

Here, a home server PC4 is configured similarly to the personal computer PC3 shown in FIG. 3, and therefore this configuration is not shown in the figure. A connector C4 corresponds to the image signal connector 31 for connecting the image signal cable to the server PC4 and the connector C4 is provided with a personal computer-side terminal TP4 for accepting the display-side terminal of the image signal cable, and a switch S4.

The display apparatus shown in FIG. 5 is characterized in that security information according to a use of the display apparatus can be set in the display apparatus. For example, among various image information acquired from web sites, information that is not appropriate for children may be prevented from being transmitted to a personal computer. In such case, the security information may be set.

In the exemplary connection configuration shown in FIG. 5, it is assumed that the display apparatus D3 is used by children and the display apparatus D4 is used by adults. On the display apparatus D3 and D4, image information transmitted from the home server PC4 is displayed. Here, according to the security information with regard to the children, in order to prevent specific image information from being displayed on the display apparatus D3 for the children, the image signal cable of the display apparatus D3 for the children is removed from the first personal computer PC1 and connected to the connector C4 of the home server PC4.

When the display-side terminal is inserted into the server-side terminal TP4 of the connector C4, the detecting circuit detects the connection of the image signal cable by the switch S4 and switches the transmission paths from the network transmission such as a LAN to the transmission by the image signal cable. Then, the home server PC4 is configured to read the security information set in the display apparatus D3 for the children when a DDC signal is communicated. According to the security information, the server PC4 prevents the specific image information that is not appropriate for the children from being sent to the image signal cable.

As described above, the server can be controlled according to the level of the security information set in the display apparatus so that the image information is displayed selectively on the display apparatus connected to the server via the image signal cable.

Though the security information set in the display apparatus is read by using the features provided in the home server PC4 for detecting the connection conditions of the image signal cable in this case, the features for detecting the connection conditions of the image signal cable may alternatively be incorporated in the first personal computer PC3 or the second personal computer PC4. When such detection features are incorporated in the first personal computer PC3 or the second personal computer PC4, these personal computers are configured similarly to the personal computer PC3 shown in FIG. 4.

In the exemplary connection configuration of the second embodiment shown in FIG. 4, as the home server PC4 has the features for detecting the connection conditions of the image signal cable, when the display apparatus D3 for the children is cable-connected to the connector C4, the image signal transmitted from the server PC4 is switched to the path via the connected image signal cable and, therefore, the image signal is not transmitted to the second personal computer PC2 that is LAN-connected to the server PC4. While the display apparatus D3 for the children is cable-connected to the connector C4, the image cannot be viewed on the display apparatus D4 for the adults.

Here, the features for detecting the connection conditions of the image signal cable are incorporated in the first personal computer PC3 or the second personal computer PC4, the image signal transmitted from the home server PC4 is supplied to the first personal computer PC1 and the second personal computer PC2. In such situation, if the security information is set in the display apparatus D3 or the display apparatus D4, the display apparatus in which the security information is set can access the home server PC4 only in a limited manner according to the level of the set security information and display the restricted image information. However, the other display apparatus in which the security information is not set can access the home server PC4 fully and is supplied with information that is not restricted. As a result, for example, the image information that is not displayed on the display apparatus D3 for the children can be displayed on the display apparatus D4 for the adults.

As described above, thanks to the configuration in which the features provided in the personal computer for detecting the connection conditions of the image signal cable and the features provided in the display apparatus for setting the security information are combined, when the image signal cable is connected, the transmission path of the image signal can be switched to the side of the connected image signal cable and, at the same time, the security information set in the display apparatus can be read, as a result of which the transmission of the image signal can be controlled from the personal computer-side according to the level of the security information.

In a display apparatus according to the present invention, as the display apparatus is provided with a connector unit that has a switch for detecting connection conditions of an image signal cable over which an image signal generated in a personal computer is transmitted so that transmission paths are switched between the image signal cable and wireless communication in response to operation of such switch, the display apparatus that typically acts as a receiver of the signal from the image signal cable can be switched to a system for receiving the image signal transmitted by the wireless communication and the like by disconnecting the image signal cable.

When the image signal cable is disconnected from the display apparatus, the display apparatus is switched to a state in which the image signal is received by the wireless communication automatically, wherein it is possible to connect with another personal computer that is disposed in a remote place on a different floor.

Thus, by providing the display apparatus with the features described above, in the configuration including one personal computer and a plurality of the above described display apparatus as illustrated above, the image information generated by the personal computer can be displayed.

Further, in the display apparatus connection system according to the present invention, as the personal computer is provided with features for detecting connection conditions of the image signal cable over which the image signal is transmitted so that transmission paths are switched between the image signal cable and the wireless communication according to the connection conditions of such image signal cable, the image signal can be transmitted even in the configuration in which typical display apparatus and other display apparatus having such features exist together.

Still further, by using the personal computer having such features as a home server and setting security information in the display apparatus for adults or the display apparatus for children, for example, it is possible to build a server system that can guarantee security for the image information, wherein full access to the server is permitted on the display apparatus for the adults, while only limited access to the server is permitted on the display apparatus for the children.

While the invention has been described with reference to specific embodiments chosen for purpose of illustration, it should be apparent that numerous modifications could be made thereto by those skilled in the art without departing from the basic concept and scope of the invention.

The present disclosure relates to subject matter contained in Japanese Patent Application No. 2002-183131, filed on Jun. 24, 2002, the disclosure of which is expressly incorporated herein, by reference, in its entirety.

What is claimed is:

1. A display apparatus which displays a transmitted image signal, comprising:

a switching circuit unit, to receive said image signal via a connector unit and wireless communication, switching transmission paths of said image signal to a display processing unit between a first transmission path that transmits said image signal through the connector unit, into which a connector terminal of a cable is inserted, and a second transmission path that transmits said image signal via the wireless communication; and a detecting circuit unit detecting insertion or withdrawal of the connector terminal of said cable into/from said connector unit, wherein said detecting circuit unit switches said switching circuit unit from said first transmission path to said second transmission path when said detecting circuit unit detects the withdrawal of said connector terminal, so as to send said image signal to said display processing unit through said second transmission path.

2. A display apparatus according to claim 1, wherein said detecting circuit unit outputs a reset signal that disables said second transmission path when said detecting circuit unit detects insertion of said connector terminal of said cable into said connector unit.

3. A display apparatus according to claim 1, wherein another image signal that is different from said image signal transmitted to said first transmission path is supplied to said second transmission path when said cable is disconnected from said connector unit.

4. A display apparatus according to claim 1, wherein said display processing unit includes a plurality of display processing units, wherein said image signal is supplied by switching the transmission paths between said first transmission path and said second transmission path in each of the plurality of display processing units.

5. A display apparatus according to claim 4, wherein, when said image signal is supplied to one of the plurality of display processing units via said first transmission path, said image signal is supplied to the other display processing unit by switching to said second transmission path.

6. A display apparatus which transmits and displays an image signal generated in information processing equipment, comprising:

a switching circuit unit, to receive said image signal via a connector unit and wireless communication, switching transmission paths of said image signal to a display processing unit between a first transmission path that transmits said image signal through the connector unit, into which a connector terminal of a cable is inserted and a second transmission path that transmits said image signal via the wireless communication; and a detecting circuit unit detecting insertion or withdrawal of the connector terminal of said cable into/from said connector unit, wherein said detecting circuit unit switches said switching circuit unit from said first transmission path to said second transmission path when said detecting circuit unit detects the withdrawal of said connector terminal, so as to send said image signal to said display processing unit through said second transmission path.

7. A display apparatus according to claim 6, wherein said information processing equipment comprises a detecting circuit unit detecting connection or disconnection of said first transmission path to/from said display processing unit.

8. A display apparatus according to claim 7, wherein security information with regard to the display in said display processing unit is set in the corresponding display processing unit, and wherein said detecting circuit unit limits and controls transmission of said image signal to said first transmission path based upon said security information that is read when said detecting circuit unit detects that said cable is connected to said connector unit of said information processing equipment.

* * * * *